US011745115B2

(12) United States Patent
Chen et al.

(10) Patent No.: US 11,745,115 B2
(45) Date of Patent: Sep. 5, 2023

(54) BUILDING BLOCK WITH EASY DISASSEMBLY AND ASSEMBLY

(71) Applicant: Dongguan Jiuchang Intelligent Technology Co., LTD, Dongguan (CN)

(72) Inventors: Jinhua Chen, Dongguan (CN); Zebing Huang, Dongguan (CN)

(73) Assignee: Dongguan Jiuchang Intelligent Technology Co., LTD, Dongguan (CN)

( * ) Notice: Subject to any disclaimer, the term of this patent is extended or adjusted under 35 U.S.C. 154(b) by 0 days.

(21) Appl. No.: 17/502,060

(22) Filed: Oct. 15, 2021

(65) Prior Publication Data

US 2022/0118377 A1 Apr. 21, 2022

(30) Foreign Application Priority Data

Oct. 21, 2020 (CN) ..... 202022359077.1

(51) Int. Cl.
*A63H 33/06* (2006.01)

(52) U.S. Cl.
CPC ..... *A63H 33/062* (2013.01)

(58) Field of Classification Search
CPC ..... A63H 33/062
See application file for complete search history.

(56) References Cited

U.S. PATENT DOCUMENTS 2,776,521 A * 1/1957 Zimmerman ..... A63H 33/065 446/124
4,055,019 A * 10/1977 Harvey ..... A63H 33/065 446/124
4,731,041 A * 3/1988 Ziegler ..... A63H 33/065 446/104
4,792,319 A * 12/1988 Svagerko ..... A63H 33/08 446/104
4,874,341 A * 10/1989 Ziegler ..... A63H 33/08 446/104
5,100,358 A * 3/1992 Volgger ..... A63H 33/08 446/104
5,501,626 A * 3/1996 Harvey ..... A63H 33/04 446/107
D409,668 S * 5/1999 Madner ..... D21/484
6,116,980 A * 9/2000 Bauer ..... A63H 33/04 446/104
6,142,848 A * 11/2000 Madner ..... A63H 33/04 446/107
6,186,855 B1 * 2/2001 Bauer ..... A63H 33/06 446/104

(Continued)

*Primary Examiner* — Eugene L Kim
*Assistant Examiner* — Matthew B Stanczak

(57) ABSTRACT

A building blocks that can be easily assembled or disassembled, comprising a building block main body. Each side of the building block main body is configured with a connecting structure. A plurality of building block main bodies is joined together through the connecting structures. The connecting structure comprises a connecting seat and a connecting rod. The connecting seat has an open connecting slot. The inner walls on the two sides of the open connecting slot are both formed with positioning bumps. The two sides of the connecting rod are respectively configured with a first and a second positioning slot. The two sides of the connecting rod are further configured with a first and a second guide slot that are respectively communicated to the first and the second positioning slot.

15 Claims, 7 Drawing Sheets

(56) References Cited

U.S. PATENT DOCUMENTS

| | | | | |
|---|---|---|---|---|
| 6,925,770 | B2 * | 8/2005 | Sorensen | A63H 33/062 446/104 |
| 7,438,623 | B2 * | 10/2008 | Lin | A63H 33/086 446/104 |
| 7,749,042 | B2 * | 7/2010 | Fulgenzi | A63H 33/06 446/124 |
| 8,197,922 | B2 * | 6/2012 | Bromley | B29C 65/56 428/53 |
| 9,498,735 | B2 * | 11/2016 | Mohanty | A63H 33/08 |
| 9,522,342 | B2 * | 12/2016 | Jazouli | A63H 33/086 |
| 9,669,324 | B2 * | 6/2017 | Roth | A63H 33/28 |
| 10,612,721 | B2 * | 4/2020 | Katz | G09F 15/0068 |
| 11,358,071 | B1 * | 6/2022 | Bagley | A63H 33/086 |
| 2001/0010992 | A1 * | 8/2001 | Brazier | A63H 33/062 446/116 |
| 2006/0145418 | A1 * | 7/2006 | Plein | A63F 9/1288 273/155 |
| 2007/0051055 | A1 * | 3/2007 | Lin | A63H 33/086 52/81.1 |
| 2010/0330867 | A1 * | 12/2010 | Fogel | A63H 33/062 446/124 |
| 2014/0270934 | A1 * | 9/2014 | Acerra | A63H 33/108 403/364 |
| 2015/0260206 | A1 * | 9/2015 | Acerra | A63H 33/086 403/364 |
| 2016/0114255 | A1 * | 4/2016 | Jazouli | A63H 33/086 446/104 |
| 2018/0099232 | A1 * | 4/2018 | Choi | A63H 33/08 |
| 2019/0321741 | A1 * | 10/2019 | Park | A63H 33/062 |

* cited by examiner

BUILDING BLOCK WITH EASY DISASSEMBLY AND ASSEMBLY

BACKGROUND OF INVENTION

1. Field of the Invention

The present invention relates generally to building blocks, and more particularly to a building block that can be easily assembled or disassembled.

2. Description of Related Art

Building blocks is a popular toy for children to train their coordination between hands and eyes. Playing the toy can stimulate the brain, nurture independent thoughts and inspire creativity. It is truly learning through play. At present, the most successful brand of building block toys is LEGO from Denmark. The company has a long history of more than 50 years, boasting numerous customers, huge markets, and extensive communities of creators and players. LEGO has become a synonym for building block puzzle toys.

There are a variety of different rules in playing building blocks. And the building block bodies are also varied in shape, including square, rectangle, triangle and cylinder, in a variety of colors. Through the different shapes and colors, children can assemble the blocks into different shapes as they wish. In this way, children's ability of imagination can be developed through the interesting game. Generally, the assembly of the building blocks are mainly up and down piling. The top of each building block is provided with a plurality of convex parts. The convex parts are arranged at equal intervals. Meanwhile, the bottom of each building block is provided with at least one embedding slot to fit with the convex parts. Thus, one building block can be joined with other building blocks by matching its convex parts with the embedding slots of other building blocks. However, when fitting the convex parts into the embedding slots, due to the lack of a guide mechanism, a large force is required to press the convex parts into the embedding slots. Moreover, to disassemble the convex parts from the embedding slots also requires a large force to separate them. Therefore, the assembly and disassembly are not easy and convenient.

SUMMARY OF THE INVENTION

The purpose of the present invention is to overcome the above shortcomings and provide a building block that is easy to disassemble and assemble.

In order to solve the above problems, the present invention adopts the following solutions:

A building block with easy disassembly and assembly, comprising a building block main body, each side of the building block main body including a connecting structure, and a plurality of the building block main bodies being connected through the connecting structure, wherein the connecting structure includes a connecting seat and a connecting rod configured on a side of the connecting seat; the connecting seat has an open connecting slot, and the positioning bumps are formed on inner walls of both sides of the open connecting slot; the connecting rod has a first positioning slot and a second positioning slot respectively disposed on both sides; two side surfaces of the connecting rod are provided with a first guide slot and a second guide slot respectively communicating with the first positioning slot and the second positioning slot.

More particularly, when joining two building block main bodies, the connecting rod of one building block main body is inserted into the open connecting slot of the connecting seat on the other building block main body, and at least one positioning bump on the inner walls on the two sides of the open connecting slot moves along the first guide slot and/or the second guide slot and fits into the first positioning slot and the second positioning slot, so that the two building block main bodies are combined and fixed together, with the relative angle being adjustable.

More particularly, wherein the first guide slot is extended to the upper end of one side of the connecting rod and the second guide slot is extended to the lower end of the other side of the connecting rod.

More particularly, wherein the positioning bump is a round convex bump.

More particularly, wherein the side of the connecting seat facing the connecting rod is formed with a connecting column protruding outward.

More particularly, wherein the building block main body is a frame body, with its center provided with a window, the front and rear end of the frame body are both configured with staged slots that are communicated to the window, and the inner side of the staged slots are further configured with a plurality of C-shaped limiting slots.

More particularly, wherein the frame body is in the shape of an equilateral triangle or a square.

More particularly, wherein the positive and negative end faces on the front side and back side of the connecting seat are respectively configured with a positive identity slot and a negative identity slot.

More particularly, wherein the building block main body is integrally made of plastics through injection forming.

The building blocks that can be easily assembled or disassembled defined in claim 1, wherein the periphery of the connecting column is configured with a ring slot, the connecting column is sleeved with an axle sleeve, the inner side of the axle sleeve is formed with a ring lug that fits into the ring slot, the axle sleeve opposite to the end joining the connecting column is configured with a rotary wheel.

More particularly, wherein the building block main body is connected to a building block member, the periphery of the building block member is configured with at least one first connecting seat and at least one first connecting rod, the first connecting seat has a first open connecting slot, the inner walls on the two sides of the first open connecting slot are formed with first positioning bumps, the two sides of the first connecting rod are respectively configured with a third positioning slot and a fourth positioning slot, the two sides of the first connecting rod are further configured with a third guide slot and a fourth guide slot respectively communicated to the third positioning slot and the fourth positioning slot, when the building block member and the building block main body are assembled, the first connecting rod of the building block member is inserted into the open connecting slot of the connecting seat of the building block main body, and at least one positioning bump on the inner walls on the two sides of the open connecting slot moves along the third guide slot and/or the fourth guide slot and fits into the third positioning slot and/or the fourth positioning slot, so that the building block member and the building block main body are assembled and fixed together, with the relative angle being adjustable, alternatively, the connecting rod of the building block main body is inserted into the first open connecting slot of the first connecting seat in the building block member, and at least one first positioning bump on the inner walls on the two sides of the first open connecting slot moves along the first guide slot and/or the second guide slot and fits into the first positioning slot and/or the second positioning slot, so that the building block member and the building block main body are assembled and fixed together, with the relative angle being adjustable.

More particularly, wherein the side of the connecting seat facing the connecting rod is further formed with a second positioning bump, when two building block main bodies are assembled, the connecting rod of one building block main body is inserted into the open connecting slot of the connecting seat in the other building block main body, between the external side face of the connecting seat of the building block main body and the external side face of the connecting seat of the other building block main body, a space is formed for the first connecting rod of the building block member to insert in, both of the inner sides of the space have the second positioning bumps, after the first connecting rod is inserted into the space, the second positioning bumps moves along the third guide slot and/or the fourth guide slot and fits into the third positioning slot and/or the fourth positioning slot, so that one building block member can be coupled with two building block main bodies, with the relative angle being adjustable.

More particularly, wherein the building block member is straight, having one the first connecting seat and one the first connecting rod.

More particularly, wherein the building block member is cross-shaped, having two the first connecting seats and two the first connecting rods, specifically, the two first connecting seat are distributed on the same straight line, and the two first connecting rods are distributed on the same straight line.

More particularly, wherein the building block member comprises a ring-shaped main body and a plurality of the first connecting seats and the first connecting rods evenly distributed on the circumference of the ring-shaped main body, the first connecting seats and the first connecting rods are equal in number and are staggered and evenly spaced between each other.

More particularly, wherein the two external sides of the first connecting seat are further configured with third positioning bumps, alternatively, the two external sides of the first connecting seat are both configured with a fifth positioning slot and a fifth positioning slot communicated to the fifth guide slot.

Comparing to the prior art, the present invention has the following benefits: in the usage of the present invention, when assembling two building block main bodies, the connecting rod of one building block main body is inserted into the open connecting slot of the connecting seat in the other building block main body, and at least one positioning bump on the inner walls on the two sides of the open connecting slot moves along the first guide slot and/or the second guide slot and fits into the first positioning slot and the second positioning slot, so that two building block main bodies are assembled and fixed together, with the relative angle being adjustable. Only a small force is required to fit the connecting rod into the open connecting slot of the connecting seat. To disassemble two building block main bodies, at least one positioning bump on the inner walls on the two sides of the connecting rod can move along the first guide slot and/or the second guide slot, and be quickly separated from the first positioning slot and the second positioning slot. Thus, only a small force is required to remove the connecting rod from the open connecting slot of the connecting seat. The operation is simple and effortless. Therefore, the present invention is suitable for small children to play with, and can be very competitive in the market.

DETAILED DESCRIPTION OF THE INVENTION

Figure 1:
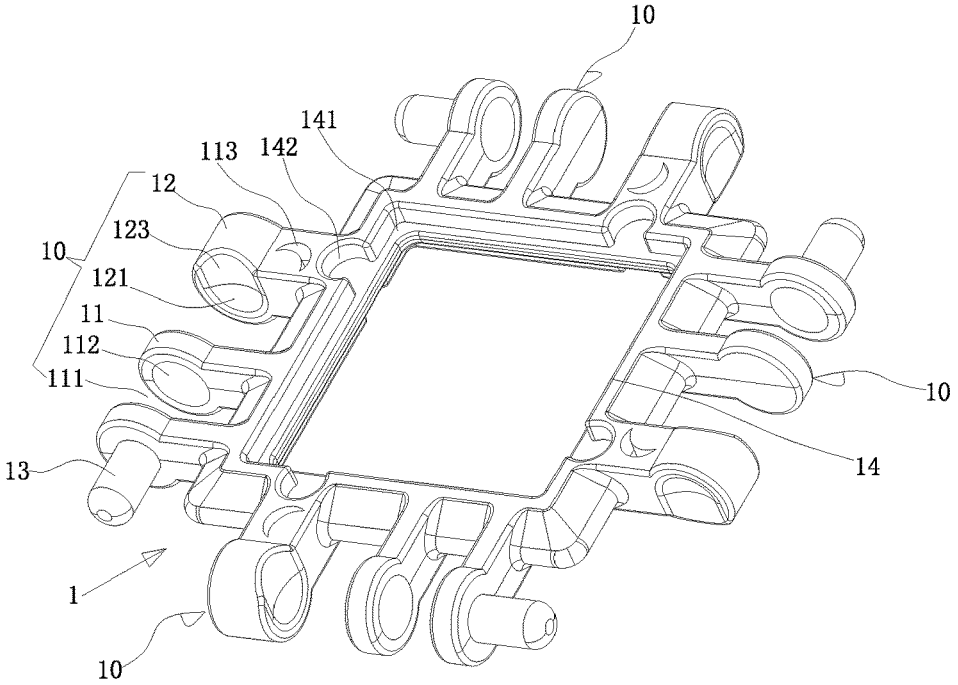
FIG. 1 is a perspective view of the building block main body according to the invention.

FIGS. 1 to 5 illustrate a kind of building blocks that can be easily assembled or disassembled, which includes a building block main body 1. Each side of the building block main body 1 is configured with a connecting structure 10. Through the connecting structures 10, a plurality of building block main bodies 1 can be connected together. The connecting structure 10 includes a connecting seat 11 and a connecting rod 12 configured on the side of the connecting seat 11. The connecting seat 11 has an open connecting slot 111. The inner walls on both sides of the open connecting slot 111 are formed with positioning bumps 112. The two sides of the open connecting slot 111 are respectively configured with a first positioning slot 121 and a second positioning slot 122. The two sides of the connecting rod 12 are respectively configured with a first guide slot 123 and a second guide slot 124 that are respectively communicated with the first positioning slot 121 and the second positioning slot 122.

In usage of the invention, to join two building block main bodies 1, the connecting rod 12 of one building block main body 1 is inserted into the open connecting slot 111 of the connecting seat 11 on the other building block main body 1. Meanwhile, at least one positioning bump 112 on the inner walls on the two sides of the open connecting slot 111 can move along the first guide slot 123 and/or the second guide slot 124 and go into the first positioning slot 121 and the second positioning slot 122, so that the two building block main bodies 1 are joined together and the relative angle is adjustable. Only a small force is required to fit the connecting rod 12 into the open connecting slot 111 of the connecting seat 11. To disassemble the two joined building block main bodies 1, at least one positioning bump 112 on the inner walls on the two sides of the connecting rod 12 can move along the first guide slot 123 and/or second guide slot 124, and be quickly separated from the first positioning slot 121 and/or the second positioning slot 122. Thus, only a small force is required to remove the connecting rod 12 from the open connecting slot 111 of the connecting seat 11. The operation is simple and effortless. Therefore, the present invention is suitable for small children to play with.

The first guide slot 123 is extended to the upper end of the side of the connecting rod 12, and the second guide slot 124 is extended to the lower end of the other side of the connecting rod 12. That is to say, the first guide slot 123 and the second guide slot 124 are opposite to each other. Only one of the positioning bumps 112 on the inner walls on the two sides of the open connecting slot 111 moves along the first guide slot 123 and/or second guide slot 124 and goes into the first positioning slot 121 and the second positioning slot 122. For example, the positioning bump 112 on the inner wall on the left side of the open connecting slot 111 can move along the first guide slot 123 and be fitted into the first positioning slot 121, whereas the positioning bump 112 on the inner wall on the right side of the open connecting slot 111 cannot move along the second guide slot 124 and be fitted into the second positioning slot 122. Thus, after the connecting rod 12 of one building block main body 1 is inserted into the open connecting slot 111 of the connecting seat 11 of the other building block main body 1, the assembled structure is more stable.

The positioning bump 112 is a round convex bump to facilitate assembly.

The side of the connecting seat 11 facing the connecting rod 12 is formed with a connecting column 13 protruding outward. The connecting column 13 can be used to connect other types of building blocks.

The building block main body 1 is a frame body, with its center provided with a window 14, the front and rear end of the frame body are both configured with staged slots 141 that are communicated to the window 14, and the inner side of the staged slots 141 are further configured with a plurality of C-shaped limiting slots 142.

Figure 2:
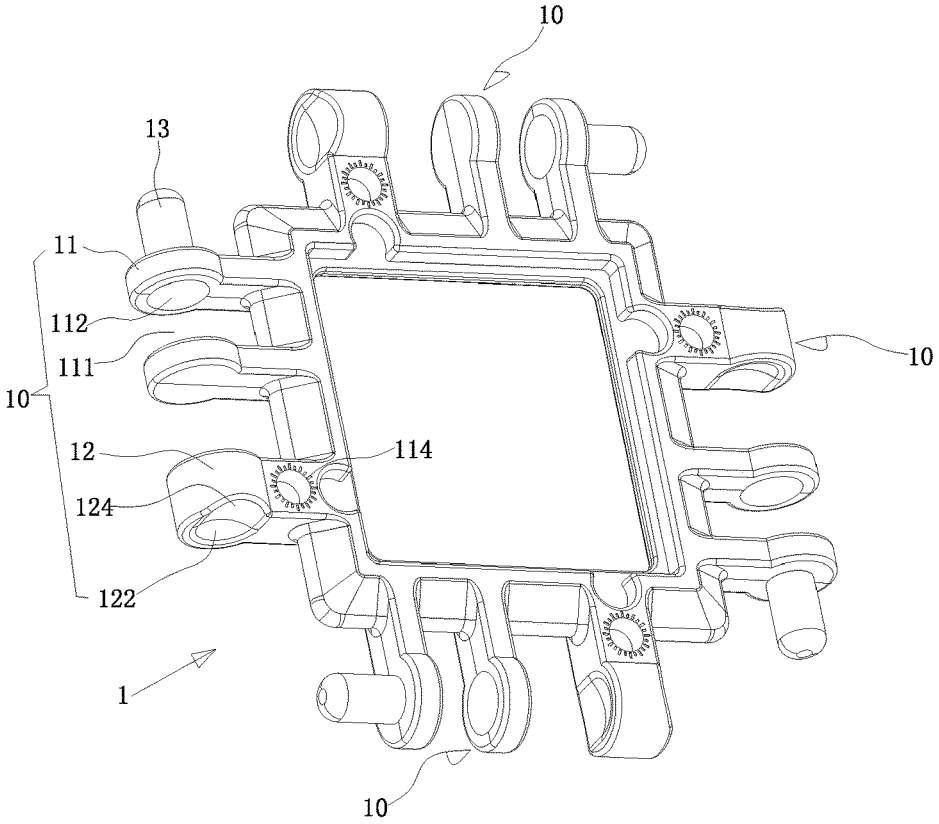
FIG. 2 is a perspective view of the building block main body in FIG. 1 from another viewing angle.
Figure 3:
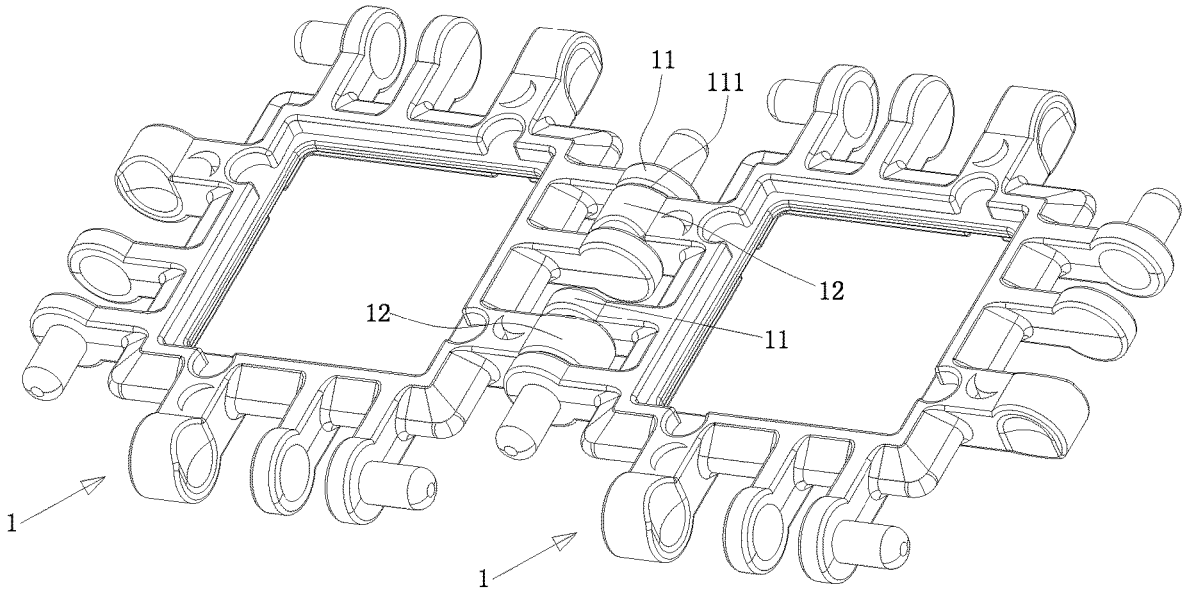
FIG. 3 is a combined view of the first type of building block main bodies joined together.
Figure 4:
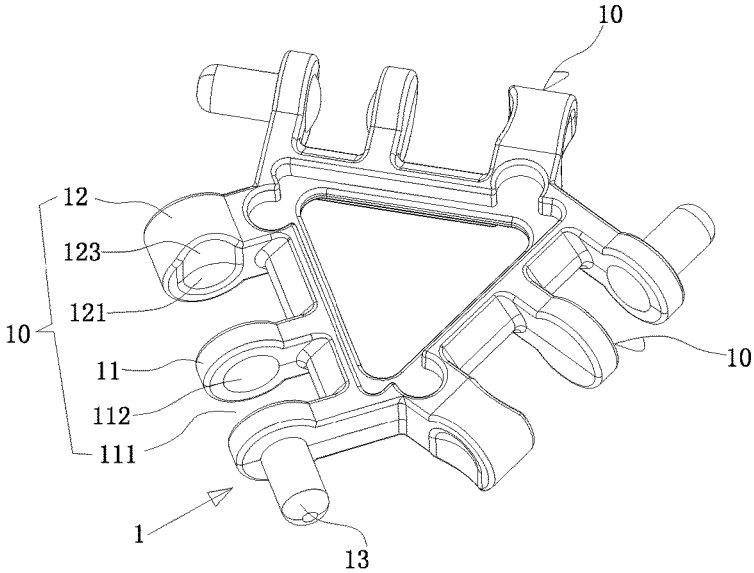
FIG. 4 is a perspective view of a second structural type of the building block main body according to the invention.
Figure 5:
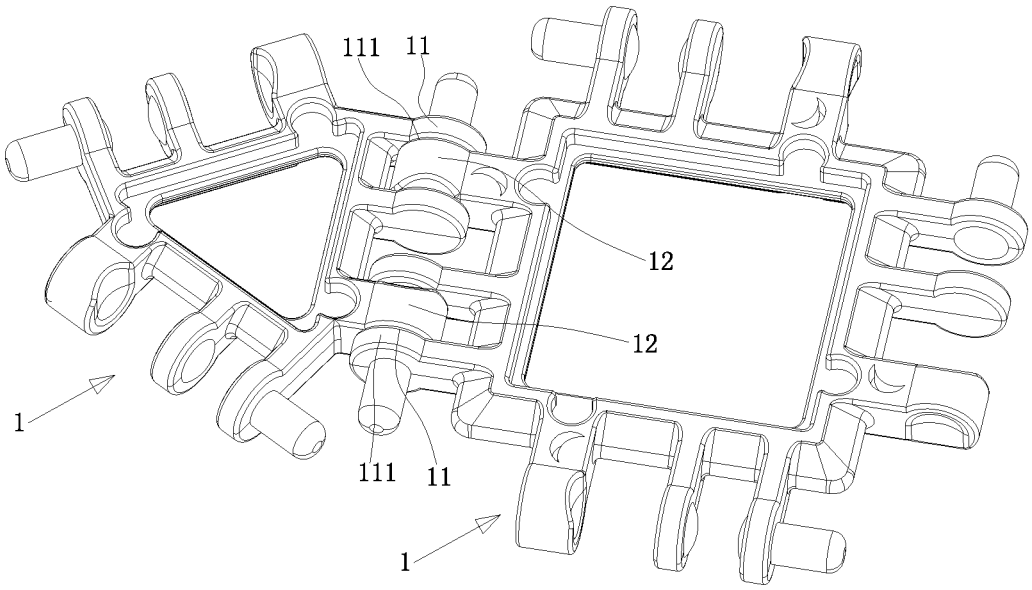
FIG. 5 is a combined view of the second type of building block main bodies joined together.

The frame body is in the shape of a triangle or a square. Specifically, the frame body is in the shape of an equilateral triangle as shown in FIG. 4, or in the shape of a square as shown in FIGS. 1, 2.

The positive and negative end faces on the front side and back side of the connecting seat 11 are respectively configured with a positive identity slot 113 and a negative identity slot 114.

The building block main body 1 is integrally made of plastics through injection forming.

Figure 6:
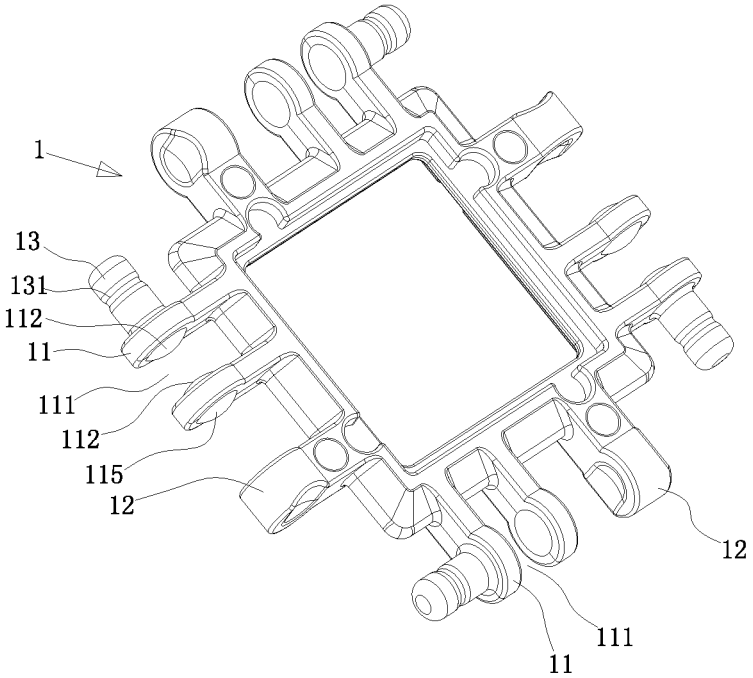
FIG. 6 is a perspective view of a third structural type of the building block main body according to the invention.
Figure 7:
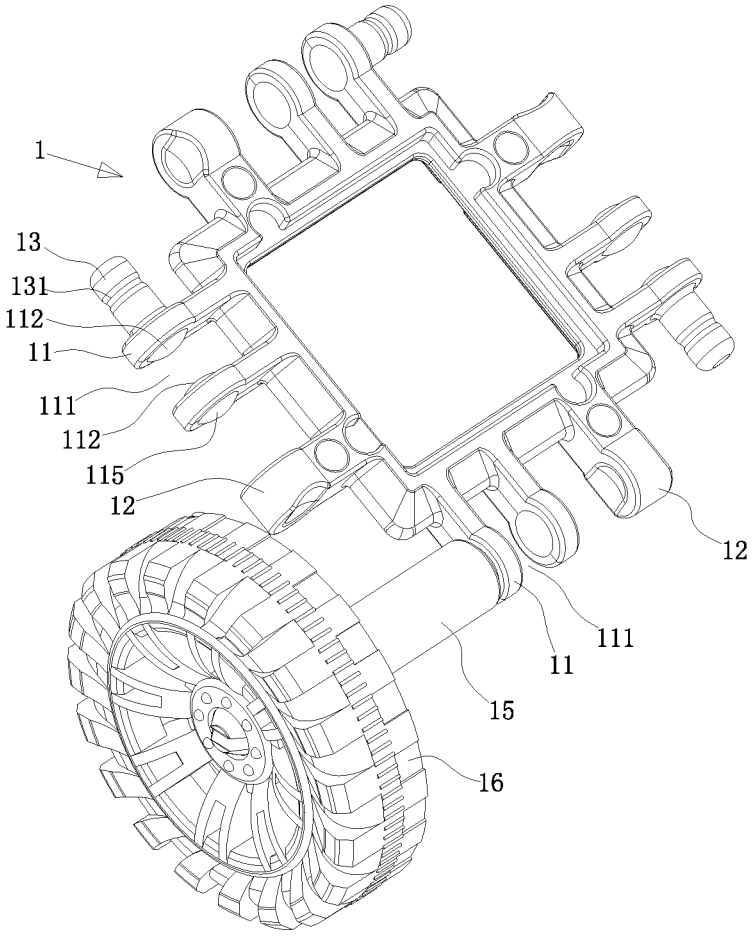
FIG. 7 is a combined view of the third structural type of the building block main body joined with an axle sleeve and a wheel.
Figure 8:
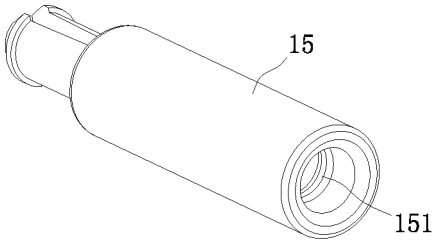
FIG. 8 is a perspective view of the axle sleeve according to the invention.
Figure 9:
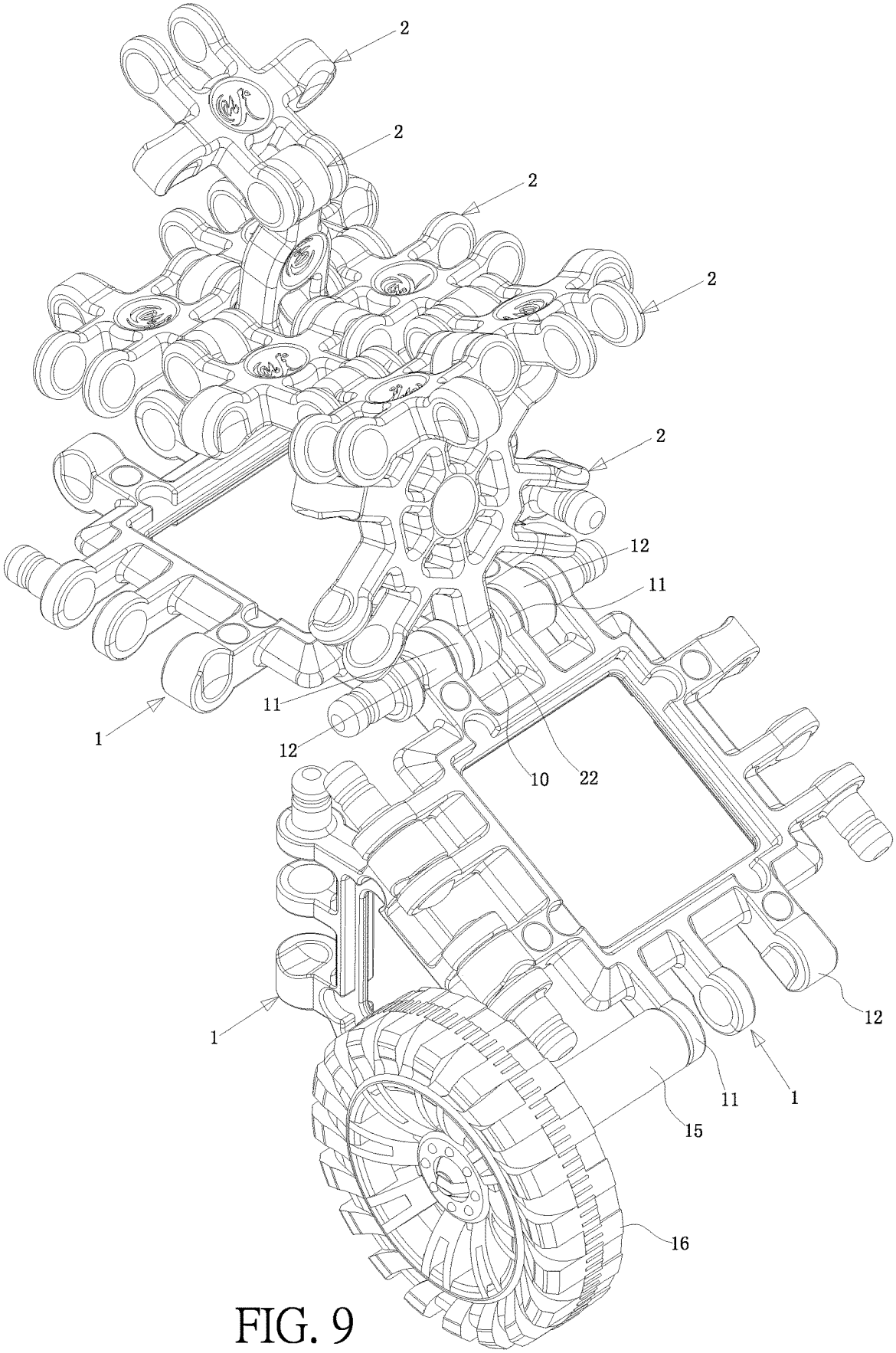
FIG. 9 is a combined view of the third structural type of the building block main body joined with a building block member, an axle sleeve and a wheel.
Figure 10:
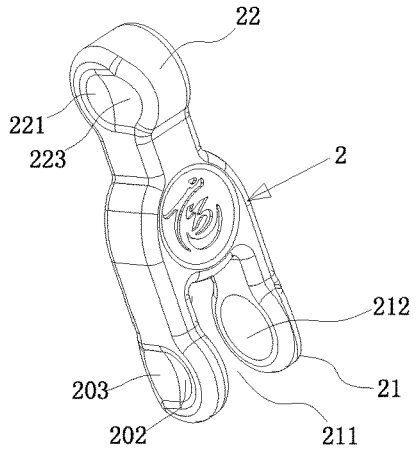
FIG. 10 is a perspective view of the first structural type of the building block member according to the invention.
Figure 11:
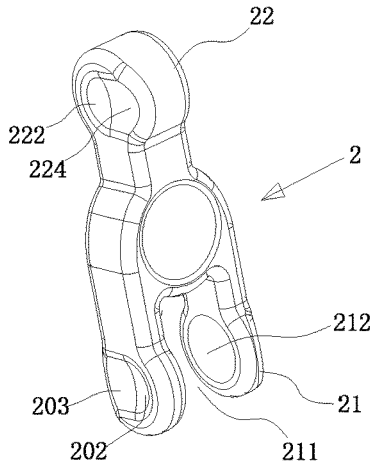
FIG. 11 is a perspective view of the building block member in FIG. 10 from another viewing angle.
Figure 12:
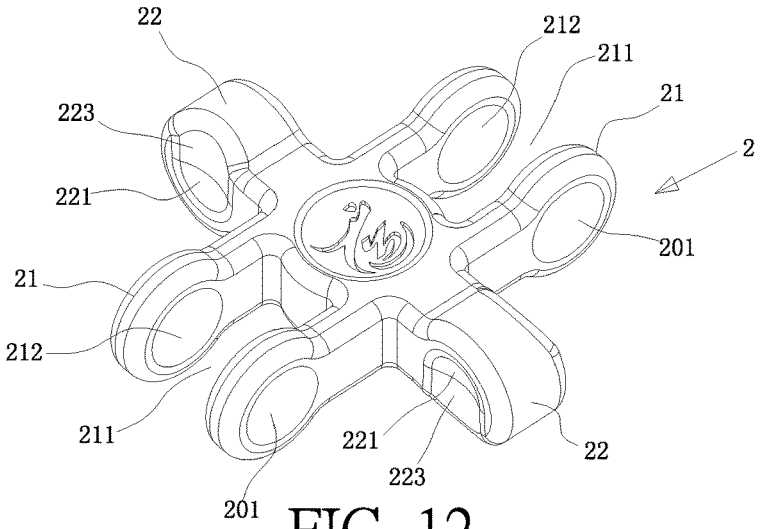
FIG. 12 is a perspective view of the second structural type of the building block member according to the invention.
Figure 13:
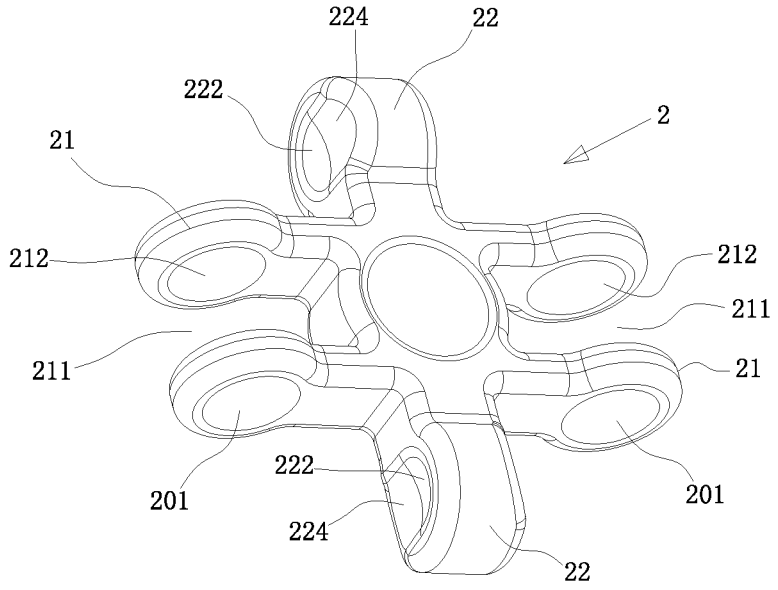
FIG. 13 is a perspective view of the building block member in FIG. 12 from another viewing angle.
Figure 14:
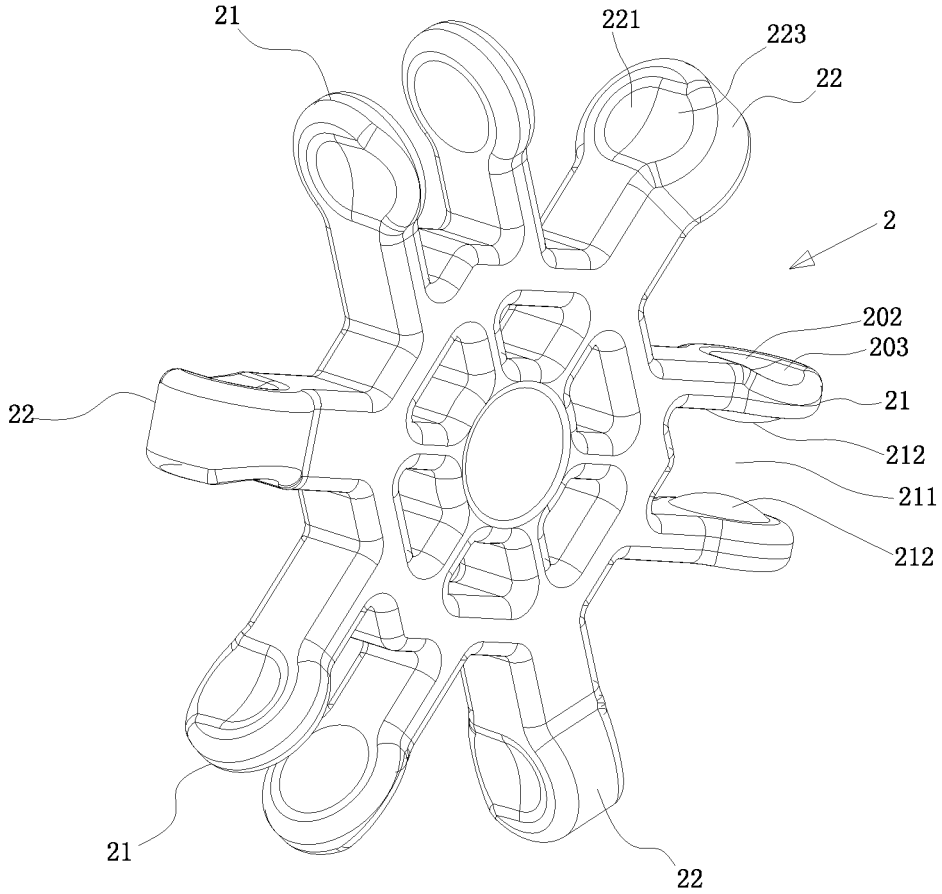
FIG. 14 is a perspective view of the third structural type of the building block member according to the invention.

Referring to FIG. 6-FIG. 8, the periphery of the connecting column 13 is configured with a ring slot 131, the connecting column 13 is sleeved with an axle sleeve 15. The inner side of the axle sleeve 15 is formed with a ring lug 151 that fits into the ring slot 131. The end of the axle sleeve 15 opposite to the end joining the connecting column 13 is configured with a rotary wheel 16, so that a car can be assembled.

Referring to FIG. 9-FIG. 14, the building block main body 1 is connected to a building block member 2. The periphery of the building block member 2 is configured with at least one first connecting seat 21 and at least one first connecting rod 22. The first connecting seat 21 has a first open connecting slot 211. The inner walls on the two sides of the first open connecting slot 211 are formed with first positioning bumps 212. The two sides of the first connecting rod 22 are respectively configured with a third positioning slot 221 and a fourth positioning slot 222. The two sides of the first connecting rod 22 are further configured with a third guide slot 223 and a fourth guide slot 224 respectively communicated to the third positioning slot 221 and the fourth positioning slot 222. When the building block member 2 and the building block main body 1 are assembled, the first connecting rod 22 of the building block member 2 is inserted into the open connecting slot 111 of the connecting seat 11 of the building block main body 1, and at least one positioning bump 112 on the inner walls on the two sides of the open connecting slot 111 moves along the third guide slot 223 and/or the fourth guide slot 224 and fits into the third positioning slot 221 and/or the fourth positioning slot 222, so that the building block member 2 and the building block main body 1 are assembled and fixed together, with the relative angle being adjustable. Alternatively, the connecting rod 12 of the building block main body 1 is inserted into the first open connecting slot 211 of the first connecting seat 21 in the building block member 2, and at least one first positioning bump 212 on the inner walls on the two sides of the first open connecting, slot 211 moves along the first guide slot 123 and/or the second guide slot 124 and fits into the first positioning slot 121 and/or the second positioning slot 122, so that the building block member 2 and the building block main body 1 are assembled and fixed together, with the relative angle being adjustable.

The above-mentioned first connecting rod has the same structure and size as the connecting rod, and the above-mentioned first connecting seat has the same structure and size as the connecting seat, so that they can be assembled with each other.

The building block main body 1 and building block member 2 can be easily assembled and disassembled. The operation is simple and effortless. Therefore, the invention is suitable for the children to play with.

The building block main body 1 and the building block member 2 also has the following assembly structures: the side of the connecting seat 11 facing the connecting rod 12 is further formed with a second positioning bump 115. When two building block main bodies 1 are assembled, the connecting rod 12 of one building block main body 1 is inserted into the open connecting slot 111 of the connecting seat 11 on the other building block main body 1. Between the external side face of the connecting seat 11 of the building block main body 1 and the external side face of the connecting seat 11 of the other building block main body 1, a space 10 is formed for the first connecting rod 22 of the building block member 2 to insert in. Both of the two inner sides of the space 10 have the second positioning bumps 115. After the first connecting rod 22 is inserted into the space 10, the second positioning bump 115 moves along the third guide slot 223 and/or the fourth guide slot 224 and fits into the third positioning slot 221 and/or the fourth positioning slot 222, so that one building block member 2 can be coupled with two building block main bodies 1, with the relative angle being adjustable.

The building block member 2 has multiple different shapes, at least is eluding the following three types:

First type: the building block member 2 is straight, having one the first connecting seat 21 and one the first connecting rod 22.

First type: the building block member 2 is cross-shaped, having two the first connecting seats 21 and two the first connecting rods 22, specifically, the two first connecting seats 21 are distributed on the same straight line, and the two first connecting rods 22 are distributed on the same straight line.

First type: the building block member 2 includes a ring-shaped main body 20 and a plurality of the first connecting seat 21 and the first connecting rod 22 evenly distributed on the circumference of the ring-shaped main body 20. The first connecting seats 21 and the first connecting rods 22 are equal in number and are staggered and evenly spaced between each other.

The two external sides of the first connecting seat 21 are further configured with third positioning bumps 201. Alternatively, the two external sides of the first connecting seat 21 are both configured with a fifth positioning slot 202 and a fifth guide slot 203 communicated to the fifth positioning slot 202, to facilitate assembly.

We claim:

1. A building block kit comprising a plurality of easy disassembly and assembly blocks, each of the first plurality of blocks comprising a building block main body (1), each side of the building block main body (1) including a connecting stricture (10), and a plurality of the building block main bodies (1) being connected through the connecting structure (10), wherein the connecting structure (10) includes a connecting seat (11) and a connecting rod (12) configured on a side of the connecting seat (11);

the connecting seat (11) has an open connecting slot (111) and a positioning bump (112) formed on inner walls of both sides of the open connecting slot (111);

the connecting rod (12) has a first positioning slot (121) and a second positioning slot (122) respectively disposed on both sides;

two side surfaces of the connecting rod (12) are provided with a first guide slot (123) and a second guide slot (124) respectively communicating with the first positioning slot (121) and the second positioning slot (122);

wherein the side of the connecting seat (11) facing the connecting rod (12) is formed with a connecting column (13) protruding outward.

2. The building block kit comprising the plurality of easy disassembly and assembly blocks of claim 1, when joining two building block main bodies (1), the connecting rod (12) of one building block main body (1) is inserted into the open connecting slot (111) of the connecting seat (11) on the other building block main body (1), and at least one positioning bump (112) on the inner walls on the two sides of the open connecting slot (111) moves along the first guide slot (123) and/or the second guide slot (124) and fits into the first positioning slot (121) and the second positioning slot (122), so that the two building block main bodies (1) are combined and fixed together, with the relative angle being adjustable.

3. The building block kit comprising the plurality of easy disassembly and assembly blocks of claim 1, wherein the first guide slot (123) is extended to the upper end of one side of the connecting rod (12) and the second guide slot (124) is extended to the lower end of the other side of the connecting rod (12).

4. The building block kit comprising the plurality of easy disassembly and assembly blocks of claim 3, wherein the positioning bump (112) is a round convex bump.

5. The building block kit comprising the plurality of easy disassembly and assembly blocks of claim 1, wherein the building block main body (1) is a frame body, with its center provided with a window (14), the front and rear end of the frame body are both configured with staged slots (141) that are communicated to the window (14), and the inner side of the staged slots (141) are further configured with a plurality of C-shaped limiting slots (142).

6. The building block kit comprising the plurality of easy disassembly and assembly blocks of claim 1, wherein the frame body is in the shape of an equilateral triangle or a square.

7. The building block kit comprising the plurality of easy disassembly and assembly blocks of claim 1, wherein the positive and negative end faces on the front side and back side of the connecting seat (11) are respectively configured with a positive identity slot (113) and a negative identity slot (114).

8. The building block kit comprising the plurality of easy disassembly and assembly blocks of claim 1, wherein the building block main body (1) is integrally made of plastics through injection forming.

9. The building blocks kit comprising the plurality of easy assembled or disassembled blocks of claim 1, wherein the periphery of the connecting column (13) is configured with a ring slot (131), the connecting column (13) is sleeved with an axle sleeve (15), the inner side of the axle sleeve (15) is formed with a ring lug (151) that fits into the ring slot (131), the axle sleeve (15) opposite to the end joining the connecting column (13) is configured with a rotary wheel (16).

10. The building block kit comprising the plurality of easy disassembly and assembly blocks of claim 1, each of the second plurality of blocks, wherein the building block main body (1) is connected to a building block member (2), the periphery of the building block member (2) is configured with at least one first connecting seat (21) and at least one first connecting rod (22), the first connecting seat (21) has a first open connecting slot (211), the inner walls on the two sides of the first open connecting slot (211) are formed with first positioning bumps (212), the two sides of the first connecting rod (22) are respectively configured with a third positioning slot (221) and a fourth positioning slot (222), the two sides of the first connecting rod (22) are further configured with a third guide slot (223) and a fourth guide slot (224) respectively communicated to the third positioning slot (221) and the fourth positioning slot (222), when the building block member (2) and the building block main body (1) are assembled, the first connecting rod (22) of the building block member (2) is inserted into the open connecting slot (111) of the connecting seat (11) of the building block main body (1), and at least one positioning bump (112) on the inner walls on the two sides of the open connecting slot (111) moves along the third guide slot (223) and/or the fourth guide slot (224) and fits into the third positioning slot (221) and/or the fourth positioning slot (222), so that the building block member (2) and the building block main body (1) are assembled and fixed together, with the relative angle being adjustable, alternatively, the connecting rod (12) of the building block main body (1) is inserted into the first open connecting slot (211) of the first connecting seat (21) in the building block member (2), and at least one first positioning bump (212) on the inner walls on the two sides of the first open connecting slot (211) moves along the first guide slot (123) and/or the second guide slot (124) and fits into the first positioning slot (121) and/or the second positioning slot (122), so that the building block member (2) and the building block main body (1) are assembled and fixed together, with the relative angle being adjustable.

11. The building block kit comprising the plurality of easy disassembly and assembly blocks of claim 10, wherein the side of the connecting seat (11) facing the connecting rod (12) is further formed with a second positioning bump (115), when two building block main bodies (1) are assembled, the connecting rod (12) of one building block main body (1) is inserted into the open connecting slot (111) of the connecting seat (11) in the other building block main body (1), between an external side face of the connecting seat (11) of the building block main body (1) and the external side face of the connecting seat (11) of the other building block main body (1), a space (10) is formed for the first connecting rod (22) of the building block member (2) to insert in, both of the inner sides of the space (10) have the second positioning bumps (115), after the first connecting rod (22) is inserted into the space (10), the second positioning bumps (115) moves along the third guide slot (223) and/or the fourth guide slot (224) and fits into the third positioning slot (221) and/or the fourth positioning slot (222), so that one building block member (2) can be coupled with two building block main bodies (1), with the relative angle being adjustable.

12. The building block kit comprising the plurality of easy disassembly and assembly blocks of claim 10, wherein the building block member (2) is straight, having one of the first connecting seat (21) and one of the first connecting rod (22).

13. The building blocks kit comprising the plurality of easy assembled or disassembled blocks of claim 10, wherein the building block member (2) is cross-shaped, having two of the first connecting seats (21) and two of the first connecting rods (22), specifically, the two of the first connecting seats (21) are distributed on the same straight imaginary line, and the two of the first connecting rods (22) are distributed on the same straight imaginary line.

14. The building blocks kit comprising the plurality of easy assembled or disassembled blocks of claim 10, wherein the building block member (2) comprises a ring-shaped main body (20) and a plurality of the first connecting seats (21) and the first connecting rods (22) evenly distributed on the circumference of the ring-shaped main body (20), the first connecting seats (21) and the first connecting rods (22) are equal in number and are staggered and evenly spaced between each other.

15. The building block kit comprising the plurality of easy disassembly and assembly of blocks claim 10, wherein two external sides of the first connecting seat (21) are further configured with third positioning bumps (201), alternatively, the two external sides of the first connecting seat (21) are both configured with a fifth positioning slot (202) and a fifth positioning slot (202) communicated to the fifth guide slot (203).

* * * * *